United States Patent [19]

Vogelsberg

[11] 4,180,034

[45] Dec. 25, 1979

[54] EXHAUST GAS RECIRCULATION CONTROL

[75] Inventor: William A. Vogelsberg, Yale, Mich.

[73] Assignee: General Motors Corporation, Detroit, Mich.

[21] Appl. No.: 909,547

[22] Filed: May 25, 1978

[51] Int. Cl.[2] ..... F02M 25/06

[52] U.S. Cl. ..... 123/119 A

[58] Field of Search ..... 123/119 A

[56] References Cited

U.S. PATENT DOCUMENTS

| | | | |
|---|---|---|---|
| 3,756,210 | 9/1973 | Kuehl | 123/119 A |
| 3,762,384 | 10/1973 | Day et al. | 123/119 A |
| 3,783,848 | 1/1974 | Ranft et al. | 123/119 A |
| 3,799,131 | 3/1974 | Bolton | 123/119 A |
| 3,800,765 | 4/1974 | Thompson | 123/119 A |
| 3,802,402 | 4/1974 | Swatman | 123/119 A |
| 3,834,363 | 9/1974 | Goto | 123/119 A |
| 3,834,366 | 9/1974 | Kingsbury | 123/119 A |
| 3,844,261 | 10/1974 | Garcea | 123/119 A |
| 3,880,129 | 4/1975 | Hollis | 123/119 A |
| 3,881,456 | 5/1975 | Nohira et al. | 123/119 A |
| 3,896,777 | 7/1975 | Masaki et al. | 123/119 A |
| 3,928,966 | 12/1975 | Goto et al. | 123/119 A |
| 3,931,813 | 1/1976 | Horie | 123/119 A |
| 3,974,807 | 8/1976 | Nohira et al. | 123/119 A |
| 3,982,515 | 9/1976 | Bradshaw | 123/119 A |
| 4,027,638 | 6/1977 | Moriya et al. | 123/119 A |
| 4,031,871 | 6/1977 | Hamanishi | 123/119 A |
| 4,041,917 | 8/1977 | Suzuki | 123/119 A |
| 4,044,735 | 8/1977 | Sumiyoshi | 123/119 A |
| 4,069,797 | 1/1978 | Nohira et al. | 123/119 A |
| 4,069,798 | 1/1978 | Thornburgh | 123/119 A |
| 4,079,710 | 3/1978 | Moriya et al. | 123/119 A |

FOREIGN PATENT DOCUMENTS

| | | | |
|---|---|---|---|
| 1380046 | 1/1971 | United Kingdom | 123/119 A |

*Primary Examiner*—Wendell E. Burns

*Attorney, Agent, or Firm*—C. K. Veenstra

[57] ABSTRACT

A transducer creates an operating pressure that positions a control valve to provide exhaust gas recirculation at rates which maintain the control pressure in the recirculation passage between the valve and an orifice equal to a reference pressure; exhaust gas recirculation thus varies with engine exhaust backpressure and accordingly is substantially proportional to induction air flow. The transducer also varies the reference pressure inversely with exhaust backpressure, thereby causing a reduction in the control pressure and a corresponding increase in the proportion of exhaust gas recirculation to induction air flow upon an increase in induction air flow.

10 Claims, 1 Drawing Figure

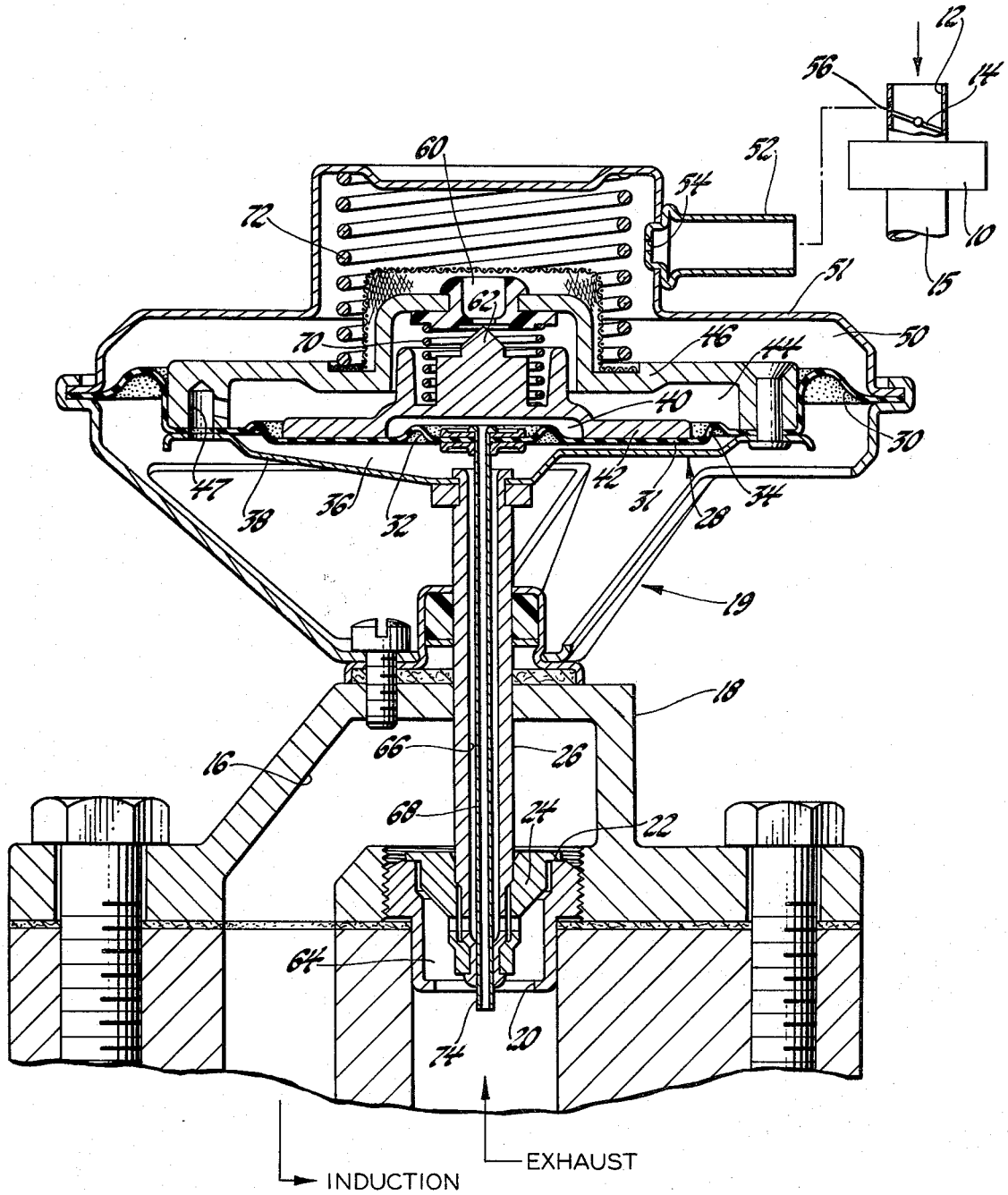
12
14
56
52
54
60
72
10
15
51
62
50
70
46
44
40
30
47
38
36
32
42
31
28
34
19
18
66
26
16
68
24
22
64
20
74
INDUCTION
EXHAUST

EXHAUST GAS RECIRCULATION CONTROL

This invention relates to control of exhaust gas recirculation and provides a novel assembly and method for controlled exhaust gas recirculation in proportion to induction air flow and for varying the proportion with induction air flow.

Recirculation of exhaust gases has been developed as a method for inhibiting formation of oxides of nitrogen during the combustion process in an internal combustion engine. In general, it is desired to recirculate exhaust gases at a rate proportional to the rate of engine induction air flow. To accomplish that purpose, exhaust gas recirculation (EGR) control assemblies have included an EGR control valve pintle positioned to provide exhaust gas recirculation at rates which maintain the control pressure in the EGR passage upstream of the pintle equal to a reference pressure. Recirculation of exhaust gases has thus been varied with exhaust backpressure, which in turn varies as a function of induction air flow, to provide exhaust gas recirculation substantially proportional to induction air flow.

Such prior EGR control assemblies generally included a transducer with a fitting sensing a subatmospheric pressure signal, an air bleed sensing atmospheric pressure, and a bleed valve controlling air flow through the bleed to create an operating pressure which positioned the control valve pintle: the bleed valve opened the air bleed to increase the operating pressure which caused the control valve pintle to reduce exhaust gas recirculation when the induction air flow (and thus the engine exhaust backpressure) decreased and the control pressure accordingly started to fall below the reference pressure, and closed the air bleed which reduced the operating pressure and caused the control valve pintle to increase exhaust gas recirculation when the induction air flow (and thus the engine exhaust backpressure) increased and the control pressure accordingly started to rise above the reference pressure. The bleed valve was carried on a control diaphragm subjected on one side to the control pressure in the EGR passage and balanced by atmospheric pressure on the opposite side and by the bias of a spring or other force producing member; the combination of atmospheric pressure and the spring or other bias formed the reference pressure.

Various controls have been used to cancel the operating pressure used by such assemblies and thus entirely preclude exhaust gas recirculation under conditions such as idle, wide open throttle and low temperature operation. For other selected conditions such as heavy load operation, however, it may be desired to provide exhaust gas recirculation in relatively high proportion to induction air flow, while for conditions such as light load operation it may be desired to provide exhaust gas recirculation in relatively low proportion to induction air flow. Yet with the prior EGR control assemblies, the proportion could be changed only by external programming of the bias of the force producing member used to create the reference pressure or by using a third valve element to adjust the area of the EGR passage upstream of the control valve pintle.

This invention provides an improved EGR control based on the prior EGR control but which allows changes in the proportion of exhaust gases recirculated without the use of a third valve element and without the necessity for external programming of the reference pressure. With the improved EGR control of this invention, a reference pressure is automatically adjusted in inverse relation to induction air flow, and a control valve then moves to whatever new position is required to provide exhaust gas recirculation at a rate which maintains a control pressure equal to the adjusted reference pressure. Thus as induction air flow increases and a higher proportion is desired, the reference pressure is automatically decreased to effect a decrease in the control pressure, while when induction air flow decreases and a lower proportion is desired, the reference pressure is automatically increased to effect an increase in the control pressure. Accordingly, the improved EGR control of this invention provides exhaust gas recirculation in proportion to induction air flow and changes the proportion by automatically effecting a change in the control pressure—decreasing the control pressure to increase the proportion, and increasing the control pressure to decrease the proportion.

In the preferred embodiment of this invention, a transducer and a control valve are combined in an integrated assembly and a tube extends through the control valve stem to sense the exhaust backpressure in the recirculation passage upstream of an orifice. The backpressure acts on the control diaphragm in the transducer in a manner tending to reduce the reference pressure on the control diaphragm, and the reference pressure accordingly varies inversely with exhaust backpressure and thus with induction air flow. However, after predetermined opening movement of the control valve, the tube no longer senses exhaust backpressure upstream of the orifice but instead senses the control pressure between the orifice and the control valve. Thus after predetermined opening movement of the control valve, the reference pressure remains constant to maintain the proportion of exhaust gas recirculation to induction air flow at the relatively high proportion.

The details as well as other features and advantages of this invention are set forth in the remainder of the specification and are shown in the drawing, the sole FIGURE of which is a schematic view of an exhaust gas recirculation control system employing a preferred embodiment of this invention.

Referring to the drawing, an internal combustion engine 10 has an air induction passage 12, a throttle 14 controlling induction air flow through passage 12, and an exhaust passage 15. An exhaust gas recirculation (EGR) passage 16 extends from exhaust passage 15 through the body 18 of an EGR control assembly 19 and then to induction passage 12 downstream of throttle 14.

An orifice 20 is disposed in EGR passage 16 upstream of a valve seat 22. A control valve pintle 24 is associated with valve seat 22 and has a stem 26 secured to a transducer 28 which is carried on an annular operating diaphragm 30.

Transducer 28 includes a control diaphragm 31 formed as an inward extension of annular operating diaphragm 30 and having central and intermediate annular portions 32 and 34 which define a portion of a control pressure chamber 36 closed by a plate 38. The central portion 32 of control diaphragm 31 also defines a portion of a backpressure chamber 40 closed by a plate 42. Plate 42 and the intermediate annular portion 34 of control diaphragm 31 further define a portion of a chamber 44 closed by a plate 46 having an opening 47 to receive air at atmospheric pressure. Plate 46 and annular operating diaphragm 30 define a portion of an operating pressure chamber 50 closed by a cover 51.

Cover 51 has a fitting 52 with an aperture 54 for sensing the pressure signal created at a port 56 in induction passage 12 adjacent the edge of throttle 14. Aperture 54 senses the subatmospheric induction passage pressure downstream of throttle 14 during open throttle operation and the substantially atmospheric pressure upstream of throttle 14 during idle and other closed throttle modes of operation.

Plate 46 has an air bleed 60 opening from atmospheric pressure chamber 44 to operating pressure chamber 50. A bleed valve 62, formed as a portion of plate 42, controls flow through air bleed 60 to regulate the operating pressure in chamber 50.

Control pressure chamber 36 senses the pressure in the zone 64 of EGR passage 16 between orifice 20 and valve seat 22 through an interior passage 66 formed by hollow valve stem 26. A tube 68 is secured to the central portion 32 of control diaphragm 31 and extends through hollow valve stem 26 to sense the backpressure in EGR passage 16 upstream of orifice 20.

During operation, an increase in pressure in zone 64 is sensed in control pressure chamber 36, and control diaphragm 31 lifts bleed valve 62 against the bias of a spring 70 and the atmospheric pressure in chamber 44 to obstruct air flow through bleed 60. The operating pressure in chamber 50 is then reduced by the subatmospheric pressure signal sensed through aperture 54, and operating diaphragm 30 is raised against the bias of a spring 72 to lift control valve pintle 24 from seat 22. The resulting increase in the exhaust gas recirculation area between control valve pintle 24 and valve seat 22 provides increased exhaust gas recirculation, and the pressure in zone 64 is reduced to balance the control pressure in chamber 36 with the reference pressure created by the biasing pressure of spring 70 and atmospheric pressure in chamber 44 and by the pressure in backpressure chamber 40.

Upon a decrease in the pressure in zone 64, spring 70 and the atmospheric pressure in chamber 44 lower control diaphragm 31, moving bleed valve 62 away from bleed 60 to permit air flow through bleed 60 into chamber 50. The increased operating pressure in chamber 50 then allows spring 72 to lower operating diaphragm 30 and control valve pintle 24. The resulting decrease in the exhaust gas recirculation area reduces exhaust gas recirculation, and the pressure in zone 64 increases to balance the control pressure in chamber 36 with the reference pressure.

EGR control assembly 19 thus positions control valve pintle 24 to provide exhaust gas recirculation at rates establishing the pressure in zone 64 necessary to maintain the control pressure in chamber 36 equal to the reference pressure. When the pressure in zone 64 equals the reference pressure, the flow of exhaust gases into zone 64 varies as a function of the exhaust backpressure in passage 15. Since the exhaust backpressure is a function of the flow through engine 10—that is, a function of the exhaust gas flow through passage 15 and thus the induction air flow through passage 12—exhaust gas recirculation through EGR passage 16 will be proportional to induction air flow through passage 12.

The lower tip 74 of tube 68 reaches through orifice 20 when control valve pintle 24 engages valve seat 22, causing chamber 40 to sense the exhaust backpressure in EGR passage 16 upstream of orifice 20. Such backpressure increases with an increase in induction air flow through passage 12. Accordingly, the pressure in backpressure chamber 40 causes the downwardly acting reference pressure on control diaphragm 31 to vary inversely with induction air flow. Upon a reduction in the reference pressure due to an increase in induction air flow, control diaphragm 31 lifts bleed valve 62 to obstruct air flow through bleed 60 and effect a reduction in the operating pressure in chamber 50. Operating diaphragm 30 then lifts control valve pintle 24 to permit exhaust gas recirculation at an increased rate which establishes a lower control pressure in zone 64 equal to the lower reference pressure. Accordingly, EGR control assembly 19 provides exhaust gas recirculation in proportion to induction air flow, and that proportion varies directly with induction air flow.

As control valve pintle 24 is moved from the fully closed position shown to a fully open position, the lower tip 74 of tube 68 passes through orifice 20 and senses the control pressure in zone 64. Thereafter, the pressure in chamber 40 will remain equal to the control pressure in zone 64 and in chamber 36, and the reference pressure will thus remain substantially constant despite further increases in induction air flow. EGR control assembly 19 then provides exhaust gas recirculation as a substantially constant, relatively high proportion of induction air flow.

It will be appreciated that the operating pressure in chamber 50 is at times dependent upon the subatmospheric induction passage pressure signal received from port 56. During closed throttle operation, port 56 senses the substantially atmospheric pressure upstream of throttle 14, and spring 72 engages control valve pintle 24 with valve seat 22 to interrupt exhaust gas recirculation. During wide open throttle operation, the pressure in induction passage 12 downstream of throttle 14 approaches atmospheric pressure, and spring 72 again engages control valve pintle 24 with valve seat 22. During a range of part throttle operation, however, variations in the induction passage pressure downstream of throttle 14 do not affect exhaust gas recirculation—for if the operating pressure in chamber 50 causes operating diaphragm 30 to move control valve pintle 24 from that position which provides exhaust gas recirculation at the rate necessary to maintain the control pressure in chamber 36 equal to the reference pressure, transducer 28 will restore the operating pressure in chamber 50 to the level necessary to return control valve pintle 24 to that position.

The foregoing describes how the control pressure in chamber 36 is balanced with the reference pressure created by the biasing pressure of spring 70 and atmospheric pressure in chamber 44 and by the pressure in backpressure chamber 40. It will be appreciated, of course, that the improved EGR control of this invention may be described as one which balances an actuating pressure created by the control pressure in chamber 36 and by the pressure in backpressure chamber 40 with the biasing pressure of spring 70 and atmospheric pressure in chamber 44.

The embodiments of the invention in which an exclusive property or privilege is claimed are defined as follows:

1. An exhaust gas recirculation control assembly for an engine having an induction passage for induction air flow and a recirculation passage for exhaust gas recirculation to said induction passage, said assembly comprising a control valve in said recirculation passage, an orifice in said recirculation passage upstream of said valve, and means for positioning said valve to provide exhaust gas recirculation at rates which maintain the control pressure in said passage between said orifice and said valve equal to a reference pressure, and wherein the improvement comprises means for varying said reference pressure inversely with the backpressure in said recirculation passage upstream of said orifice, whereby said control pressure is varied inversely with said backpressure and exhaust gas recirculation is provided as a proportion of induction air flow which varies directly with induction air flow.

2. An exhaust gas recirculation control assembly for an engine having an induction passage for induction air flow and a recirculation passage for exhaust gas recirculation to said induction passage, said assembly comprising an orifice in said recirculation passage, a valve for regulating an operating pressure in response to a deviation of the control pressure in said recirculation passage between said orifice and said control valve from a reference pressure, and a control valve in said recirculation passage downstream of said orifice for producing an exhaust gas recirculation area in accordance with said operating pressure to provide exhaust gas recirculation at rates which maintain said control pressure equal to said reference pressure, and wherein the improvement comprises means for varying said reference pressure inversely with the backpressure in said recirculation passage upstream of said orifice, whereby said control pressure is varied inversely with said backpressure and exhaust gas recirculation is provided as a proportion of induction air flow which varies directly with induction air flow.

3. An exhaust gas recirculation control assembly for an engine having an induction passage for induction air flow and a recirculation passage for exhaust gas recirculation to said induction passage, said assembly comprising a diaphragm defining a portion of an operating pressure chamber, said chamber having an aperture for sensing a subatmospheric pressure signal and also having an air bleed and combining the pressures sensed through said aperture and said bleed to form an operating pressure, an orifice in said recirculation passage, a control valve in said recirculation passage downstream of said orifice and positioned by said diaphragm to produce an exhaust gas recirculation area in inverse relation to said operating pressure, a control diaphragm subjected to a biasing pressure, means for subjecting said control diaphragm to the backpressure in said recirculation passage upstream of said orifice in opposition to said biasing pressure to thereby establish a reference pressure on said control diaphragm which varies inversely with said backpressure, said control diaphragm defining a portion of a control pressure chamber having means for sensing the pressure in the zone of said recirculation passage between said orifice and said control valve, and a bleed valve positioned by said control diaphragm for obstructing flow through said bleed when the control pressure in said control pressure chamber exceeds said reference pressure, whereby said control valve is positioned to provide exhaust gas recirculation at rates which establish the pressure in said zone necessary to maintain said control pressure equal to said reference pressure and thereby cause said control pressure to vary inversely with said backpressure and thus provide exhaust gas recirculation as a proportion of an induction air flow which varies directly with induction air flow.

4. An exhaust gas recirculation control assembly for an engine having an induction passage for induction air flow, a recirculation passage for exhaust gas recirculation to said induction passage, an orifice in said recirculation passage, a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage downstream of said orifice and positioned by said diaphragm to produce an exhaust gas recirculation area in inverse relation to said operating pressure, said assembly comprising a control diaphragm defining a portion of a control pressure chamber having means for sensing the pressure in the zone of said recirculation passage between said orifice and said valve, a plate carried by a portion of said control diaphragm and defining a backpressure chamber therebetween, said backpressure chamber including means for sensing the backpressure in said recirculation passage upstream of said orifice, said backpressure in said backpressure chamber contributing to a reference pressure which varies inversely with said backpressure and acts on said control diaphragm in opposition to the control pressure in said control pressure chamber, and a bleed valve positioned by said control diaphragm for obstructing flow through said bleed when said control pressure exceeds said reference pressure, whereby said control valve may be positioned to provide exhaust gas recirculation at rates which establish the pressure in said zone necessary to maintain said control pressure equal to said reference pressure and thereby cause said control pressure to vary inversely with said backpressure and thus provide exhaust gas recirculation as a proportion of an induction air flow which varies directly with induction air flow.

5. An improvement in an exhaust gas recirculation control assembly for an engine having an induction passage for induction air flow, a recirculation passage for exhaust gas recirculation to said induction passage, an orifice in said recirculation passage, a diaphragm defining a portion of an operating pressure chamber, said chamber having an aperture for sensing a subatmospheric pressure signal and also having an air bleed and combining the pressures sensed through said aperture and said air bleed to form an operating pressure, a control valve in said recirculation passage downstream of said orifice and positioned by said diaphragm to produce an exhaust gas recirculation area in inverse relation to said operating pressure, a control diaphragm defining a portion of a control pressure chamber having means for sensing the pressure in the zone of said recirculation passage between said orifice and said valve, and a bleed valve positioned by said control diaphragm to obstruct flow through said bleed when the control pressure in said control pressure chamber exceeds a reference pressure, said improvement comprising means subjecting said control diaphragm to the backpressure in said recirculation passage upstream of said orifice in opposition to said control pressure for thereby varying said reference pressure inversely with said backpressure, whereby said control valve may be positioned to provide exhaust gas recirculation at rates which establish the pressure in said zone necessary to maintain said control pressure equal to said reference pressure and thereby cause said reference pressure to vary inversely with said backpressure and thus provide exhaust gas recirculation as a proportion of induction air flow which varies directly with induction air flow.

6. An exhaust gas recirculation control assembly for an engine having an induction passage for induction air flow and a recirculation passage for exhaust gas recirculation to said induction passage, said assembly comprising a control valve in said recirculation passage, an orifice in said recirculation passage upstream of said valve, a diaphragm having a central portion and annular intermediate and outer portions, a first plate overlying and movable with said central portion of said diaphragm and defining a backpressure chamber therebetween, a second plate overlying said first plate and said intermediate portion of said diaphragm and defining an atmospheric pressure chamber therebetween, a third plate overlying said second plate and said outer portion of said diaphragm and defining an operating pressure chamber therebetween, a fourth plate underlying said central and intermediate portions of said diaphragm and defining a control pressure chamber therebetween and movable with said outer portion of said diaphragm, said third plate having an aperture for sensing a subatmospheric pressure signal and said second plate having an air bleed opening from said atmospheric pressure chamber to said operating pressure chamber to thereby create an operating pressure in said operating pressure chamber, a stem interconnecting said valve and said fourth plate for positioning said valve to produce an exhaust gas recirculation area in inverse relation to said operating pressure, said stem defining a passage for subjecting said control pressure chamber to the pressure in the zone of said recirculation passage between said valve and said orifice, and a tube extending through said valve and said stem for subjecting said backpressure chamber to the backpressure in said recirculation passage upstream of said orifice, wherein the atmospheric pressure in said atmospheric pressure chamber acting on said first plate and said intermediate portion of said diaphragm and the pressure in said backpressure chamber acting on said first plate contribute to a reference pressure acting on said intermediate portion of said diaphragm and opposing the control pressure in said control pressure chamber, and wherein said first plate has a bleed valve obstructing flow through said bleed when said control pressure exceeds said reference pressure, whereby said control valve is positioned to provide exhaust gas recirculation at rates which establish the pressure in said zone necessary to maintain said control pressure equal to said reference pressure to thereby cause said control pressure to vary inversely with said backpressure and thus provide exhaust gas recirculation as a proportion of induction air flow which varies directly with induction air flow.

7. An exhaust gas recirculation control assembly for an engine having an induction passage for induction air flow and a recirculation passage for exhaust gas recirculation to said induction passage, said assembly comprising a control valve in said recirculation passage movable between a closed position inhibiting exhaust gas recirculation and an open position permitting exhaust gas recirculation, an orifice in said recirculation passage upstream of said valve, a diaphragm having a central portion and annular intermediate and outer portions, a first plate overlying and movable with said central portion of said diaphragm and defining a backpressure chamber therebetween, a second plate overlying said first plate and said intermediate portion of said diaphragm and defining an atmospheric pressure chamber therebetween, a third plate overlying said second plate and said outer portion of said diaphragm and defining an operating pressure chamber therebetween, a fourth plate underlying said central and intermediate portions of said diaphragm and defining a control pressure chamber therebetween and movable with said outer portion of said diaphragm, said third plate having an aperture for sensing a subatmospheric pressure signal and said second plate having an air bleed opening from said atmospheric pressure chamber to said operating pressure chamber to thereby create an operating pressure in said operating pressure chamber, a stem interconnecting said valve and said fourth plate for positioning said valve to produce an exhaust gas recirculation area in inverse relation to said operating pressure, said stem defining a passage for subjecting said control pressure chamber to the pressure in the zone of said recirculation passage between said valve and said orifice, and a tube extending through said valve and said stem for subjecting said backpressure chamber to the back-pressure in said recirculation passage upstream of said orifice when said valve is between said closed position and a position intermediate said open and closed positions and for subjecting said backpressure chamber to said control pressure when said valve is between said intermediate and open positions, wherein the atmospheric pressure in said atmospheric pressure chamber acting on said first plate and said intermediate portion of said diaphragm and the pressure in said backpressure chamber acting on said first plate contribute to a reference pressure acting on said intermediate portion of said diaphragm and opposing the control pressure in said control pressure chamber, and wherein said first plate has a bleed valve obstructing flow through said bleed when said control pressure exceeds said reference pressure, whereby said control valve is positioned to provide exhaust gas recirculation at rates which establish the pressure in said zone necessary to maintain said control pressure equal to said reference pressure to thereby cause said control pressure to vary inversely with said backpressure and thus provide exhaust gas recirculation as a proportion of induction air flow which varies directly with induction air flow when said valve is between said closed and intermediate positions and to thereby maintain said control pressure substantially constant and thus provide exhaust gas recirculation as a substantially constant proportion of induction air flow when said valve is between said intermediate and open positions.

8. The method of controlling exhaust gas recirculation in an engine having an induction passage for induction air flow, a recirculation passage for exhaust gas recirculation to said induction passage, a control valve in said recirculation passage movable between a closed position inhibiting exhaust gas recirculation and an open position permitting exhaust gas recirculation, means for effecting movement of said valve between said open and closed positions, and an orifice in said recirculation passage upstream of said valve, said method comprising the steps of:

subjecting said means to a biasing pressure tending to effect movement of said valve toward one of said positions, subjecting said means to an actuating pressure by subjecting said means to the control pressure in said recirculation passage between said valve and said orifice in a sense tending to effect movement of said valve toward the other of said positions and by subjecting said means to the backpressure in said recirculation passage upstream of said orifice in a sense tending to effect movement of said valve toward said open position, and thereby causing said means to effect movement of said valve between said open and closed positions to maintain said actuating pressure equal to said biasing pressure, whereby said control pressure is varied inversely with said backpressure and exhaust gas recirculation is provided as a proportion of induction air flow which varies directly with induction air flow.

9. The method of controlling exhaust gas recirculation in an engine having an induction passage for induction air flow, a recirculation passage for exhaust gas recirculation to said induction passage, a control valve in said recirculation passage movable between a closed position inhibiting exhaust gas recirculation and an open position permitting exhaust gas recirculation, means for effecting movement of said valve between said open and closed positions, and an orifice in said recirculation passage upstream of said valve, said method comprising the steps of:

subjecting said means to the control pressure in said recirculation passage between said orifice and said valve in a sense tending to effect movement of said valve toward one of said positions, subjecting said means to a reference pressure by subjecting said means to a biasing pressure in a sense tending to effect movement of said valve toward the other of said positions and by subjecting said means to the backpressure in said recirculation passage upstream of said orifice in a sense tending to effect movement of said valve toward said open position, and thereby causing said means to effect movement of said valve between said open and closed positions to maintain said control pressure equal to said reference pressure, whereby said control pressure is varied inversely with said backpressure and exhaust gas recirculation is provided as a proportion of induction air flow which varies directly with induction air flow.

10. The method of controlling exhaust gas recirculation in an engine having an induction passage for induction air flow, a recirculation passage for exhaust gas recirculation to said induction passage, a control valve in said recirculation passage movable between a closed position inhibiting exhaust gas recirculation and an open position permitting exhaust gas recirculation, means for effecting movement of said valve between said open and closed positions, and an orifice in said recirculation passage upstream of said valve, said method comprising the steps of:

subjecting said means to the control pressure in said recirculation passage between said orifice and said valve in a sense tending to effect movement of said valve toward said open position, subjecting said means to a reference pressure by subjecting said means to a biasing pressure in a sense tending to effect movement of said valve toward said closed position and by subjecting said means to the backpressure in said recirculation passage upstream of said orifice in a sense tending to effect movement of said valve toward said open position when said valve is between said closed position and a position intermediate said open and closed positions and by subjecting said means to said control pressure in a sense tending to effect movement of said valve toward said open position when said valve is between said intermediate and open positions, and thereby causing said means to effect movement of said valve between said open and closed positions to maintain said control pressure equal to said reference pressure, whereby said control pressure varies inversely with said backpressure and exhaust gas recirculation is provided as a proportion of induction air flow which varies directly with induction air flow when said valve is between said closed and intermediate positions, and whereby said control pressure is maintained equal to said biasing pressure and exhaust gas recirculation is provided as a substantially constant proportion of induction air flow when said valve is between said intermediate and open positions.

* * * * *